United States Patent [19]

Reiff et al.

[11] 4,327,699

[45] May 4, 1982

[54] CONTROL FOR OPERATING MIXTURE IN INTERNAL COMBUSTION ENGINES

[75] Inventors: Karl Reiff, Plochingen; Eberhard Hofmann, Kirchberg; Josef Güntert, Gerlingen, all of Fed. Rep. of Germany

[73] Assignee: Robert Bosch GmbH, Stuttgart, Fed. Rep. of Germany

[21] Appl. No.: 188,438

[22] Filed: Sep. 19, 1980

[30] Foreign Application Priority Data

Oct. 3, 1979 [DE] Fed. Rep. of Germany ..... 2940061

[51] Int. Cl.[3] ..... F02M 25/06

[52] U.S. Cl. ..... 123/568; 123/452; 123/454

[58] Field of Search ..... 123/568, 454, 452, 569

[56] References Cited

U.S. PATENT DOCUMENTS

| | | | |
|---|---|---|---|
| 4,031,873 | 6/1977 | Banzhaf et al. | 123/568 |
| 4,196,708 | 4/1980 | May et al. | 123/568 |
| 4,205,645 | 6/1980 | Eheim | 123/568 |
| 4,228,773 | 10/1980 | Stumpp et al. | 123/568 |
| 4,230,080 | 10/1980 | Stumpp et al. | 123/568 |

FOREIGN PATENT DOCUMENTS

| | | | |
|---|---|---|---|
| 2658051 | 7/1978 | Fed. Rep. of Germany | 123/454 |

*Primary Examiner*—Charles J. Myhre

*Assistant Examiner*—Magdalen Moy

*Attorney, Agent, or Firm*—Edwin E. Greigg

[57] ABSTRACT

An apparatus is proposed for the open-loop control of the composition of the operating mixture to be introduced into the combustion chambers of an internal combustion engine. In this apparatus, the dispensing of the aspirated air quantity is effected by means of an aspirated air throttle device, whose displacement complementarily adjusts the cross section of an exhaust gas recirculation line which discharges into the intake system downstream from this throttle device. The opening of the aspirated air throttle device in order to increase the quantity of aspirated air is effected by means of a control pressure delivered to a servomotor, counter to the force of a restoring spring. The control pressure is obtained from the comparison of the actual quantity of aspirated air with the fuel injection quantity. The initial pressure for establishing the control pressure is the supply pressure of a supply pump supplying the fuel metering device. In order to prevent the throttle device for aspirated air from being moved into the closed position during starting of the engine, an additional adjusting device, also actuated by fuel supply pressure, is provided. When supply pressure is absent, this adjusting device moves the aspirated air throttle device into the opening direction counter to the restoring force. At the same time, the outlet opening of the exhaust recirculation line is closed as a result.

3 Claims, 1 Drawing Figure

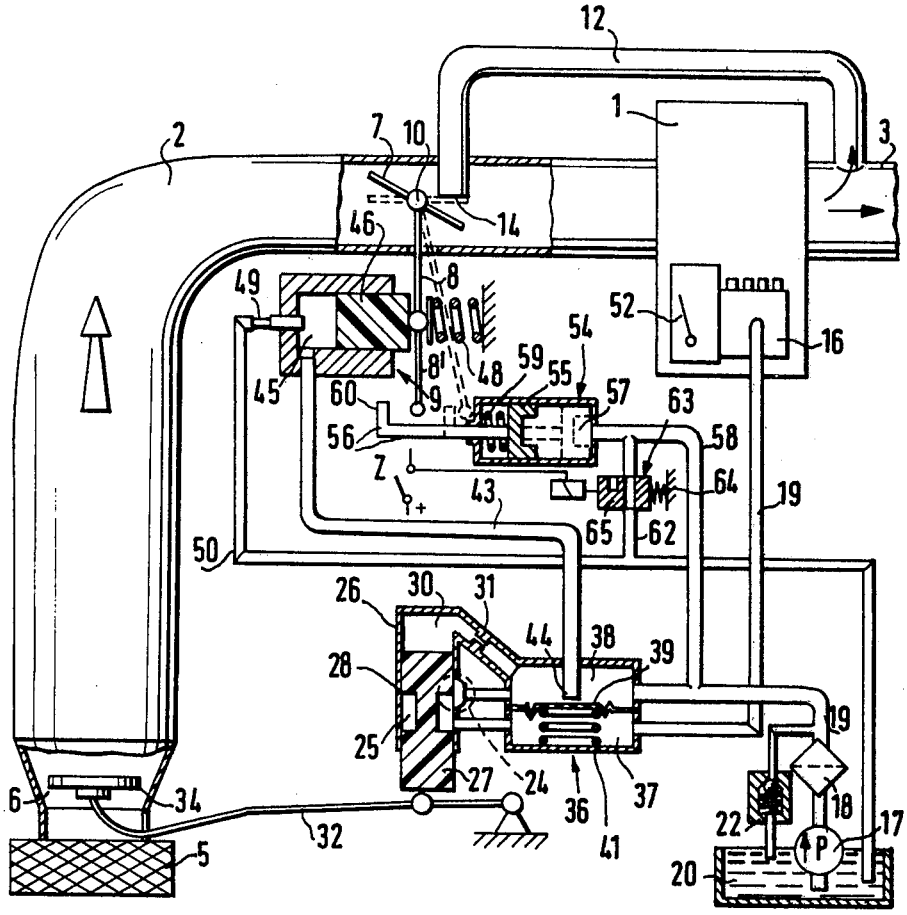
12
1
3
2
7
10
14
46
8
49
52
16
54
8'
48
59
55
57
45
60
9
63
56
58
Z
43
64
19
65
62
50
26
30
31
44
38
39
28
19
25
27
24
37
6
34
36
18
22
17
32
41
5
20
P

CONTROL FOR OPERATING MIXTURE IN INTERNAL COMBUSTION ENGINES

BACKGROUND OF THE INVENTION

The invention relates to an apparatus for open-loop control of the operating mixture (including fuel, air, recirculated exhaust gas) to be introduced into the combustion chambers of an internal combustion engine. In known apparatus of this kind, the throttle device, actuated by a servomotor, which aspirates air quantities is in the closed position upon starting of the engine. The control device for recirculated exhaust gas quantities is accordingly in the open position. The open-loop control device functions such that a control pressure, which is generated by a fuel pump and increases with an increasing fuel injection quantity, is generated to actuate the servomotor. This control pressure moves the throttle device for aspirated air quantities in the opening direction counter to a restoring force of a spring. Upon starting of the engine, this control pressure is absent, so that because of the throttled aspirated air quantity and the opened exhaust gas recirculation device, there is an undesirable emission of smoke upon starting in the prior art device.

OBJECT AND SUMMARY OF THE INVENTION

An object of the invention is to provide an apparatus for starting an engine in a simple and inexpensive fashion. This is achieved by an apparatus which provides open-loop control of the operating mixture (fuel, air, recirculated exhaust gas) to be introduced into the combustion chambers of an internal combustion engine. A servomotor is provided for actuating a throttle device for aspirated air which acts in complementary fashion to a control device for recirculated exhaust gas. The servomotor is actuatable by the pressure generated by a supply pump counter to the force of a spring. The work chamber of a second servomotor functions counter to the force of a restoring spring and communicates with the pressure side of the fuel supply pump. This servomotor has a holder element which limits the path of the first servomotor in the closing direction of the aspirated air throttle device such that when pressure is absent in the work chamber of the second servomotor, the aspirated air throttle device is moved into the open position. Thus, once the engine has been brought into operation, or upon attainment of the established supply pressure of the fuel supply pump, the apparatus is removed from the influence of the servomotor for actuating the throttle device for aspirated air.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows one exemplary embodiment of the invention, which is described in detail below.

DESCRIPTION OF THE PREFERRED EMBODIMENT

In the drawing, an internal combustion engine 1 is shown in simplified form, having an intake tube 2 and an exhaust manifold 3. The intake tube 2 is provided with an air filter 5 and is immediately adjacent an especially shaped air funnel 6, widening in the direction of flow toward the engine. A throttle valve 7, which communicates via a linkage rod 8 with a hydraulic servomotor 9, is provided downstream from the air funnel 6 in the intake tube 2. An exhaust gas recirculation line 12 leading from the exhaust manifold 3 discharges into the intake tube 2 downstream of the shaft 10 of this throttle valve 7. The outlet opening 14 of the exhaust recirculation line 12, which is located in the middle of the intake tube 2, is located in the pivoting range of the half of the throttle valve 7 located downstream of the shaft 10 and is closed thereby when the throttle valve 7 is fully open. The engine is embodied here as an auto-igniting internal combustion engine and is supplied with fuel in a known manner by means of an injection pump 16. The pump 16 may be a series injection pump or a distributor-type injection pump, functioning by either the overflow principle or the suction throttle principle.

A fuel supply system is assembled as follows. The injection pump 16 is supplied with fuel by a fuel supply pump 17 via a fuel supply line 19. The fuel supply pump 17 is followed immediately by a fuel filter 18 and a pressure regulation valve 22 is provided parallel thereto and to the fuel supply pump 17 in an outflow line leading to the fuel supply container 20. With this pressure regulation valve 22 is it possible to attain a predetermined and substantially constant fuel supply pressure, which can furthermore be influenced over a long period by appropriately selected operating parameters, such as air pressure or temperature.

A variable metering cross section 24 is provided in the fuel supply line 19 and is embodied as a slit-like flowthrough cross section of the fuel supply line 19, which discharges into an annular chamber 25 in a guide bore 26. The annular chamber 25 is embodied by an outer annular groove of a control slide 27, which is displaceable within the guide bore 26. The first limiting edge 28 of the control slide 27, in accordance with the position of the control slide 27, controls the open cross section of the slit-like metering cross section 24, which extends in the direction of displacement of the control slide 27. The fuel supply line 19, which is unclosable by the control slide 27, leads away from the annular chamber 25 to the suction side of the injection pump 16. The metering cross section 24 can naturally also be provided at the opposite location, at the outlet of the fuel supply line 19 from the annular chamber 25.

At the end of the guide bore 26, the control slide 27 encloses a pressure chamber 30, which communicates via a throttle 31 with the fuel supply line 19 upstream of the metering cross section 24. The control slide 27 is pressed by the fuel pressure prevailing in this pressure chamber 30 against a lever arm 32, which is supported at one end; a baffle plate 34 lying transverse to the air flow direction is secured on the free end, which protrudes into the region of the air funnel 6, of this lever arm 32. This baffle plate 34 is deflected, as a result of the impact pressure of the air flow or the pressure difference acting upon it between the air pressure upstream and the air pressure downstream of the baffle plate, counter to the substantially constant force generated by the fuel pressure and transmitted by the control slide 27 until such time as a balance of forces has been established. With the aid of the specialized shaping of the air funnel 6, it can be attained that various adjustment paths on the part of the baffle plate 34 are required for the continuous enlargement of the free annular surface area between the baffle plate 34 and the air funnel wall, to maintain a constant pressure difference at the baffle plate. On the other hand, as a result of the slit-like embodiment of the metering cross section 24, the metering cross section varies in linear fashion with the adjustment path of the baffle plate. When the restoring force on the control slide 27 is held constant, it is thus possible to establish a desired ratio of air to fuel which is adapted to the various operational ranges of the engine.

The pressure drop at the metering cross section 24 is controlled by a differential pressure valve 36. A first pressure chamber 37 communicates with the fuel supply line 19 downstream of the metering cross section 24 and a second pressure chamber 38 communicates with the fuel supply line upstream of the metering cross section 24. In the exemplary embodiment under discussion, these pressure chambers 37 and 38 are located directly in the fuel supply line 19. The two pressure chambers 37 and 38 are separated from one another by a diaphragm 39, which is subject on the side of the first pressure chamber 37 to the force of a compression spring 41 which is attached there. A relief line 43 protrudes into the second pressure chamber 38 at right angles to the diaphragm surface, and its opening 44 and the diaphragm 39 form a valve.

The relief line 43, as a supply line for servo medium, leads into the work chamer 45 of the servomotor 9, whose servo device 46, embodied here by way of example as a hydraulic piston, is subjected to the force of a compression spring 48 counter to the hydraulic servo pressure. The servo device, which may also be embodied as a diaphragm, for example, is thus coupled with the linkage rod 8 for adjusting the throttle valve 7. The work chamber 45 further communicates via a fixed throttle 49 in a return flow line 50 with the fuel supply container 20.

The apparatus described above functions as follows:

Assuming a stationary operational status of the engine, if the quantity adjusting device of the injection pump 16 is displaced via a lever 52 in the direction of a large fuel injection quantity, then more fuel must be supplied to the injection pump 16 via the fuel supply line 19. At a position of the control slide 27 which is at first constant, however, this causes a sharper pressure drop at the metering cross section 24 and a reduction in the pressure in the first pressure chamber 37 of the differential pressure valve. This valve acts as a comparision device, with which the actual fuel quantity supplied to the engine can be compared with the aspirated fresh air quantity, which, assuming an established dependency on the fuel-air ratio, corresponds to the fuel quantity flowing over the metering cross section 24. The pressure drop in the first pressure chamber 37 effects a displacement of the diaphragm 39 and thus an enlargement of the open cross section at the outflow opening 44 of the relief line 43. The fuel outflow quantity which has thus been increased effects an increase of the pressure being established at the throttle 49, which in turn, being exerted in the work chamber 45, effects a displacement of the servo device 46 counter to the force of the compression spring 48. The throttle valve is moved in corresponding fashion in the opening direction, which in turn causes an increase in the quantity of fresh air delivered, while simultaneously reducing the quantity of recirculated exhaust gas.

The intake underpressure generated by the engine can now be exerted to a greater extent on the baffle plate 34 because of the enlarged intake tube flow-through cross section at the throttle valve. Thus the baffle plate 34, under the influence of the briefly increased pressure difference, is deflected still further outward, until a balance of forces again prevails on the lever arm 32 as a result of the increase in the free annular surface area or the reduction of the throttling at this flow-through cross section. As a result of the displacement of the lever arm 32, the metering cross section 24 has also changed, so that the pressure drop at the metering cross section which has been determined by the design of the differential pressure valve has again been established. The change in the fuel quantity flowing out via the relief line 43 corresponds to the result of the comparison between the fuel quantity actually delivered and the aspirated fresh air quantity, or to the deviation from the set-point value established at the differential pressure valve.

If, on the other hand, the lever 52 is moved in the direction of a small fuel quantity, or even a zero fuel quantity, then the regulation process described above takes its course in reverse order. As a result of the reduced fuel supply quantity to the fuel injection pump, the pressure in the first pressure chamber 37 at first increases, so that the diaphragm 39 moves in the closing direction toward the opening 44 of the relief line 43. However, the pressure in the work chamber 45 is thereby reduced in such a manner that the compression spring 48 moves the throttle valve 7 in the closing direction, until the pressure in the second pressure chamber 38 has been appropriately balanced by the corrective displacement of the control slide 27.

At the time the engine is started, however, there is no supply pressure available in the fuel supply line 19, so that the throttle valve 7 is moved into the closed position under the influence of the compression spring 48. At the same time, the outlet opening 14 of the exhaust recirculation line 12 is fully opened. This takes place whether the cross section of the exhaust recirculation line 12 is controlled in a fashion complementary to the free flow-through cross sectional surface in the intake tube 2 by means of one half of the throttle valve, as in the illustrated example, or is varied by means of appropriate force-transmitting elements by a separate closing member. When there is resistance on the part of the engine, there is accordingly an air deficiency at first, so that particularly at low temperatures there is an undesirable amount of smoke emission. In order to prevent this, a supplementary apparatus is described below.

The supplementary apparatus substantially comprises a second servomotor 54, which has a working piston 55, with which a holder element 56 is firmly connected. The working piston 55 encloses within a cylinder a work chamber 57, which communicates continuously via a connecting line 58 with the portion of the fuel supply line 19 located upstream of the metering cross section 24. The working piston 55 is also stressed by a restoring spring 59, which is preferably embodied as a compression spring. The holder element 56 firmly connected to the working piston 55 and protruding outward is embodied in hook-like fashion in such a manner that the hook-like end 60 protrudes within the pivotal range of the linkage rod 8, which is guided outward via the articulation point on the working piston 46 of the first servomotor 9. The drawing shows the working pistion 55 of the second servomotor 54 in the position which it assumes when the described control apparatus is in operation. The systemic systemic pressure which prevails in the work chamber 57 has compressed the compression spring 59 and displaced the hook-like end of the holder element 56 to such an extent that it is located outside the possible pivoting range of the lengthened linkage rod 8'. Thus the movement of the working piston 46 is in no manner hindered.

If the engine is shut off, then the pressure in the supply line 19 and work chamber 57 drops to zero. Accordingly, the working piston 55 is displaced under the influence of the restoring spring 59 up to its rear stop, while the hook-like end 60 engages the lengthened portion 8' of the linkage rod 8 and moves the throttle valve 7 in the opening direction counter to the force of the restoring spring 48. At the same time, the outlet opening 14 of the exhaust recirculation line 12 is accordingly closed.

In order to accelerate this process upon shutoff of the engine, especially when the pressure in the fuel supply line 19 decreases only slowly, the work chamber 57 can additionally be relieved toward the fuel supply container 20 via a relief line 62 in which there is a magnetic valve 63. The magnetic valve 63 is so controlled that it obtains electric current from the starting switch Z of the internal combustion engine, and when the switch is in the excited state the valve will have closed the relief line 62. Upon shutoff of the engine, the magnetic valve 63 also has no electric current, so that the closing member 65 of the magnetic valve 63 is brought into the opened position under the influence of a restoring spring 64.

In the apparatus described above, a single throttle device having a double function has been used as the throttle device for the aspirated air and for the recirculated exhaust gas. Naturally it is also possible to use one throttle device for each of the two mediums, then coupling the two throttle devices together. The apparatus according to the invention can be realized in the same manner in this case, with appropriate adaptation.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an open-loop control apparatus for a fuel supply system in an internal combustion engine, wherein the internal combustion engine includes an intake tube through which aspirated air flows, an exhaust gas recirculation line connected to the intake tube, and at least one combustion chamber to receive the recirculated exhaust gas and the aspirated air, wherein the fuel supply system includes a fuel supply pump which provides fuel to the at least one combustion chamber, a fuel metering device connected to the fuel supply pump, a control device connected to regulate the exhaust gas flow in the exhaust gas recirculation line, a throttle device connected to regulate the aspirated air flow in the intake tube, a first servomotor connected to actuate the throttle device and the control device in a complementary manner, and wherein the servomotor is connected to be actuable by the fuel supply pump pressure, a first biasing spring connected to bias the first servomotor couner to the fuel supply pump pressure; and wherein the open-loop control apparatus includes:

a second servomotor, having a work chamber, connected to be actuable by the fuel supply pump pressure, and further having a holder element;

a second biasing spring connected to bias the second servomotor counter to the fuel supply pump pressure;

wherein the holder element is mounted to limit the movement of the first servomotor depending on work chamber pressure such that the throttle device is in an open position when work chamber pressure falls to zero.

2. An open-loop control apparatus as defined in claim 1, further including:

a magnetic valve a fuel relief line fluidly connected to the work chamber via the magnetic valve which regulates the flow of fuel in the fuel relief line.

3. An open-loop control apparatus as defined in claim 2, wherein the magnetic valve includes a restoring spring, further including:

an electric switch, which is dependent on operation of the internal combustion engine, controls the magnetic valve such that the fuel relief line is closed when the internal combustion engine is on and such that the fuel relief line is opened by the restoring spring when the internal combustion engine is off.

* * * * *